US009777426B2

(12) United States Patent
Favaro et al.

(10) Patent No.: US 9,777,426 B2
(45) Date of Patent: Oct. 3, 2017

(54) LAUNDRY WASHING MACHINE

(71) Applicant: Electrolux Home Products Corporation N.V., Brussels (BE)

(72) Inventors: Daniele Favaro, Venice (IT); Elena Pesavento, Porcia (IT); Elisa Stabon, Gorizia (IT); Maurizio Del Pos, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 73 days.

(21) Appl. No.: 14/424,887

(22) PCT Filed: Aug. 9, 2013

(86) PCT No.: PCT/EP2013/066734
§ 371 (c)(1),
(2) Date: Feb. 27, 2015

(87) PCT Pub. No.: WO2014/032942
PCT Pub. Date: Mar. 6, 2014

(65) Prior Publication Data

US 2015/0211171 A1 Jul. 30, 2015

(30) Foreign Application Priority Data

Aug. 29, 2012 (EP) ..... 12182212

(51) Int. Cl.
*D06F 39/08* (2006.01)
*D06F 39/04* (2006.01)

(52) U.S. Cl.
CPC ..... *D06F 39/088* (2013.01); *D06F 39/04* (2013.01); *D06F 39/083* (2013.01)

(58) Field of Classification Search
CPC ..... D06F 39/04; D06F 39/083; D06F 39/088
See application file for complete search history.

(56) References Cited

U.S. PATENT DOCUMENTS 2,896,436 A 7/1959 Buechler
3,162,032 A 12/1964 Behrens
(Continued)

FOREIGN PATENT DOCUMENTS

CN 101177892 A 5/2008
CN 101696544 A 4/2010
(Continued)

OTHER PUBLICATIONS

Machine translation of DE 3401899 A1, no date.*
(Continued)

*Primary Examiner* — Joseph L Perrin
(74) *Attorney, Agent, or Firm* — Banner & Witcoff, Ltd.

(57) ABSTRACT

A laundry washing machine (1) includes a washing tub (3) external to a rotatable washing drum (4) adapted to receive laundry. The machine further includes a water supply circuit (5) to supply water into the washing tub (3), a washing/rinsing products supplier (6) to supply washing/rinsing products into the washing tub (3), a heater device (10) placed at the bottom (3*a*) of the washing tub (3) for heating a liquid coming into contact with it and a liquid output (37) placed at the bottom (3*a*) of the washing tub (3) for introducing liquid into the washing tub (3). The liquid output (37) is arranged in such a way to emit a jet of said liquid below the heater device (10), the jet having a main flowing direction (L) substantially parallel or pointed to the bottom (3*a*) of the washing tub (3), so as to remove washing/rinsing products collected therein.

16 Claims, 9 Drawing Sheets

(56) References Cited

U.S. PATENT DOCUMENTS

| | | | | |
|---|---|---|---|---|
| 3,305,093 | A | 2/1967 | Brubaker et al. | |
| 4,696,171 | A | 9/1987 | Babuin | |
| 4,711,103 | A | 12/1987 | Mori et al. | |
| 4,986,093 | A | 1/1991 | Pastryk et al. | |
| 4,987,627 | A | 1/1991 | Cur et al. | |
| 5,193,361 | A | 3/1993 | Singh et al. | |
| 5,493,745 | A | 2/1996 | Hauch | |
| 6,295,411 | B1 * | 9/2001 | Fastman | F24H 9/0042 122/4 A |
| 7,454,927 | B2 | 11/2008 | Luckman et al. | |
| 7,921,493 | B2 | 4/2011 | Kim et al. | |
| 2002/0032932 | A1 * | 3/2002 | Kim | D06F 37/12 8/158 |
| 2004/0244433 | A1 * | 12/2004 | Lee | D06F 39/083 68/12.13 |
| 2005/0183208 | A1 | 8/2005 | Scheper et al. | |
| 2006/0108454 | A1 | 5/2006 | Eichholz | |
| 2008/0216250 | A1 * | 9/2008 | Lee | D06F 39/04 8/158 |
| 2009/0094990 | A1 | 4/2009 | Nitschmann et al. | |
| 2009/0095030 | A1 | 4/2009 | Kang | |
| 2011/0056030 | A1 * | 3/2011 | Bang | D06F 33/02 8/159 |
| 2012/0036650 | A1 * | 2/2012 | Hong | D06F 25/00 8/137 |
| 2012/0137740 | A1 | 6/2012 | Kikikawa et al. | |
| 2012/0304394 | A1 | 12/2012 | Dawudian | |
| 2014/0096572 | A1 | 4/2014 | Kim et al. | |
| 2014/0109323 | A1 | 4/2014 | Kim et al. | |

FOREIGN PATENT DOCUMENTS

| | | | | |
|---|---|---|---|---|
| CN | 102021797 | A | 4/2011 | |
| CN | 102373602 | A | 3/2012 | |
| DE | 3401899 | A1 * | 7/1985 | D06F 35/00 |
| DE | 3721433 | A1 * | 1/1989 | D06F 39/086 |
| DE | 19814884 | A1 | 10/1999 | |
| EP | 0240992 | A2 | 10/1987 | |
| EP | 0386724 | A1 | 3/1990 | |
| EP | 0736626 | A2 | 10/1996 | |
| EP | 1967634 | A2 | 9/2008 | |
| EP | 2392720 | A1 | 12/2011 | |
| EP | 2423368 | A1 | 2/2012 | |
| ES | 293549 | U | 8/1986 | |
| JP | 2007111161 | A | 5/2007 | |
| KR | 20100082481 | A | 7/2010 | |
| WO | 2008/119630 | A1 | 10/2008 | |

OTHER PUBLICATIONS

Jan. 27, 2014—(WO) International Search Report—App PCT/EP2013/066734.

Mar. 3, 2014—(WO) International Search Report—App PCT/EP2013/066752.

Apr. 1, 2016 (CN) First Office Action—App 201380044696.1.

Aug. 26, 2016 (CN) Chinese Office Action—App 201380044696.1.

Feb. 16, 2016 (US) Non-Final Office Action—U.S. Appl. No. 14/424,853.

Aug. 25, 2016 (US) Final Office Action—U.S. Appl. No. 14/424,853.

Feb. 2, 2017 (US) Non-Final Office Action—U.S. Appl. No. 14/424,853.

* cited by examiner

LAUNDRY WASHING MACHINE

Aspects of the present invention concerns the field of laundry washing techniques.

In particular, aspects of the present invention refers to a laundry washing machine capable of performing a more efficient detergent dissolution.

BACKGROUND

Nowadays the use of laundry washing machines, both "simple" laundry washing machines (i.e. laundry washing machines which can only wash and rinse laundry) and laundry washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing provided with a washing tub which contains a rotatable perforated drum where the laundry is placed.

A loading/unloading door ensures access to the drum.

Laundry washing machines typically comprise a water inlet circuit and a products supply unit for the introduction of water and washing/rinsing products (i.e. detergent, softener, etc.) into the tub.

Known laundry washing machines are also provided with water draining devices that may operate both during the initial phases of the washing cycle and at the end of the same to drain the dirty water.

According to the known technique, a complete washing cycle typically includes different phases during which the laundry to be washed is subjected to adequate treatments.

A washing cycle usually comprises a laundry wetting phase with addition of a washing detergent and a main washing phase during which the drum is rotated and the water contained therein is heated to a predetermined temperature based on the washing program selected by the user. During the main washing phase the drum is rotated, so as to apply also a mechanical cleaning action on the laundry. At the end of the main washing phase the drum is typically rotated at high rotational speed, in such a way that dirty washing liquid (i.e. water mixed with detergent) is extracted from the laundry, and this dirty washing liquid is drained by the water draining devices.

A successive step of the cycle typically comprises a rinsing phase which usually comprises one or more rinsing cycles. In the rinsing cycle, clean rinse water is first added to the laundry, so as to be absorbed by the laundry and remove from the latter detergent and/or dirty particles not previously removed by washing liquid, and then the drum is rotated to extract water and dirty particles/detergent from the laundry: the dirty water extracted is drained from the tub to the outside by the water draining devices.

After the rinsing phase, a final spinning phase allows the extraction of the residual water contained in the wet laundry.

The water extracted during the spinning phase is drained towards the outside by means of the water draining devices (during or after the spinning phase).

A laundry washing machine performing a washing cycle is disclosed in document EP1967634A2.

Such laundry washing machine comprises a tub having a cylindrical structure for containing washing water and a rotary drum rotatably installed in the tub.

The machine further comprises a heater for heating washing water. The heater is installed in the lower portion of the tub. The machine comprises a washing device for spraying washing water to the heater to wash the heater.

The washing device substantially comprises a recirculating circuit provided with a recirculating pump which withdraws liquid from the bottom of the tub and sprays said liquid to the heater through a spray nozzle. The sprayed liquid washes the heater by removing substances stuck to the heater.

The spray nozzle is installed below the heater so that the washing liquid is vertically sprayed against the heater from below.

However, the laundry washing machines of the known art pose some drawbacks. A drawback posed by the laundry washing machines of the known art is that the washing products, or the rinsing products (e.g. laundry softener), which are introduced into the washing tub during the washing cycle, move towards the bottom part of the tub, due to their high density and, therefore, tend to accumulate on the bottom of the tub.

Accumulation of these products does not ensure a complete and/or a fast dissolution of the products themselves in the water. It is well known that a fast and/or complete dissolution has a positive impact on the washing performance. Due to such undesired accumulation of products, therefore, the machine of known type does not have a high efficiency.

Furthermore, washing performance may be different for each washing cycle depending on the percentage of product which accumulates on the bottom of the tub and hence does not completely dissolve.

Therefore, the washing performance may vary from time to time and cannot be properly controlled.

Another drawback deriving from accumulation of washing/rinsing products in the bottom of the tub is that the sedimentation of such products may favour the proliferation of bacteria, which may then worsen the hygienic conditions and may cause bad smells.

SUMMARY

An object of the present invention is therefore to overcome the drawbacks posed by the known techniques.

It is one object of the invention to provide a laundry washing machine that makes it possible to improve the washing efficiency of the machine itself.

It is a further object of the invention to provide a laundry washing machine that makes it possible to guarantee invariable efficiency during the time.

It is another object of the invention to provide a laundry washing machine that makes it possible to reduce proliferation of bacteria therefore improving hygienic conditions.

The applicant has found that by providing a laundry washing machine comprising a washing tub external to a rotatable washing drum adapted to receive laundry, a heater device placed at the bottom of the washing tub for heating a liquid coming into contact with it, a liquid output placed at said bottom of said washing tub for introducing liquid into said washing tub and providing that said liquid output is arranged in such a way to emit a jet of liquid so as to remove washing/rinsing products collected therein, is possible to obtain a laundry washing machine having and increased washing efficiency compared to the machines of known type.

Aspects of the present invention relates, therefore, to a laundry washing machine comprising:

- a washing tub external to a rotatable washing drum adapted to receive laundry;

a water supply circuit to supply water into the washing tub;

a washing/rinsing products supplier to supply washing/rinsing products into the washing tub;

a heater device placed at the bottom of the washing tub for heating a liquid coming into contact with it;

a liquid output placed at the bottom of the washing tub for introducing liquid into the washing tub;

wherein the liquid output is arranged in such a way to emit a jet of liquid below the heater device, this jet having a main flowing direction substantially parallel or pointed to the bottom of the washing tub, so as to remove washing/rinsing products collected therein.

Preferably, the liquid output is defined in a terminal portion of a pipe.

Opportunely, the terminal portion is arranged in such a way that the speed of the liquid at the liquid output is greater than the speed of the liquid in any other points inside the terminal portion.

In a preferred embodiment of the invention, the machine comprises a recirculation circuit suitable for withdrawing liquid from the washing tub, the recirculation circuit having a recirculation pipe comprising the terminal portion provided with the liquid output.

Preferably, the terminal portion comprises an end portion wherein the liquid output is defined, the end portion having an internal cross section which area decreases in the direction of the liquid output.

More preferably, the end portion comprises a conical-shaped or pyramidal-shaped duct.

In a preferred embodiment of the invention, the liquid output is circular.

In a further preferred embodiment of the invention, the liquid output is rectangular.

In a preferred embodiment of the invention, the terminal portion further comprises a tubular portion adjacent to the end portion.

Advantageously, the tubular portion extends along an axis which is parallel to the main flowing direction.

Preferably, the washing tub comprises a seat suitable for receiving the heater device, the main flowing direction of the emitted jet being substantially parallel or pointed to the bottom of such seat.

Advantageously, the main flowing direction does not intersect the heater device.

In a further preferred embodiment of the invention, the machine comprises a further water supply circuit suitable for conveying liquid into the washing tub, the further water supply circuit having a pipe comprising the terminal portion provided with the liquid output.

The further water supply circuit is advantageously connected to an external water supply line.

Preferably, the machine comprises a further recirculation circuit suitable for withdrawing liquid from the washing tub and to re-admit such a liquid into an upper region of the washing tub.

In a preferred embodiment of the invention, the machine is a laundry washing-drying machine.

BRIEF DESCRIPTION OF THE DRAWINGS

Further characteristics and advantages of the present invention will be highlighted in greater detail in the following detailed description of a preferred embodiment of the invention, provided with reference to the enclosed drawings.

In said drawings.

Figure 11:
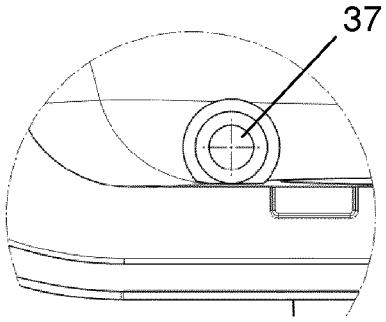
FIG. 11 is a front plan view of the detail of FIG. 9.

Figures from 12 to 16 show further embodiments of FIG. 11.

DETAILED DESCRIPTION

The present invention has proved to be particularly advantageous when applied to laundry washing machines, as described below. It should in any case be underlined that the present invention is not limited to laundry washing machines. On the contrary, the present invention can be conveniently applied to laundry washing-drying machines (i.e. laundry washing machines which can also dry laundry).

In the present description, therefore, the term "laundry washing machine" will refer to both simple laundry washing machines and laundry washing-drying machines.

Figure 1:
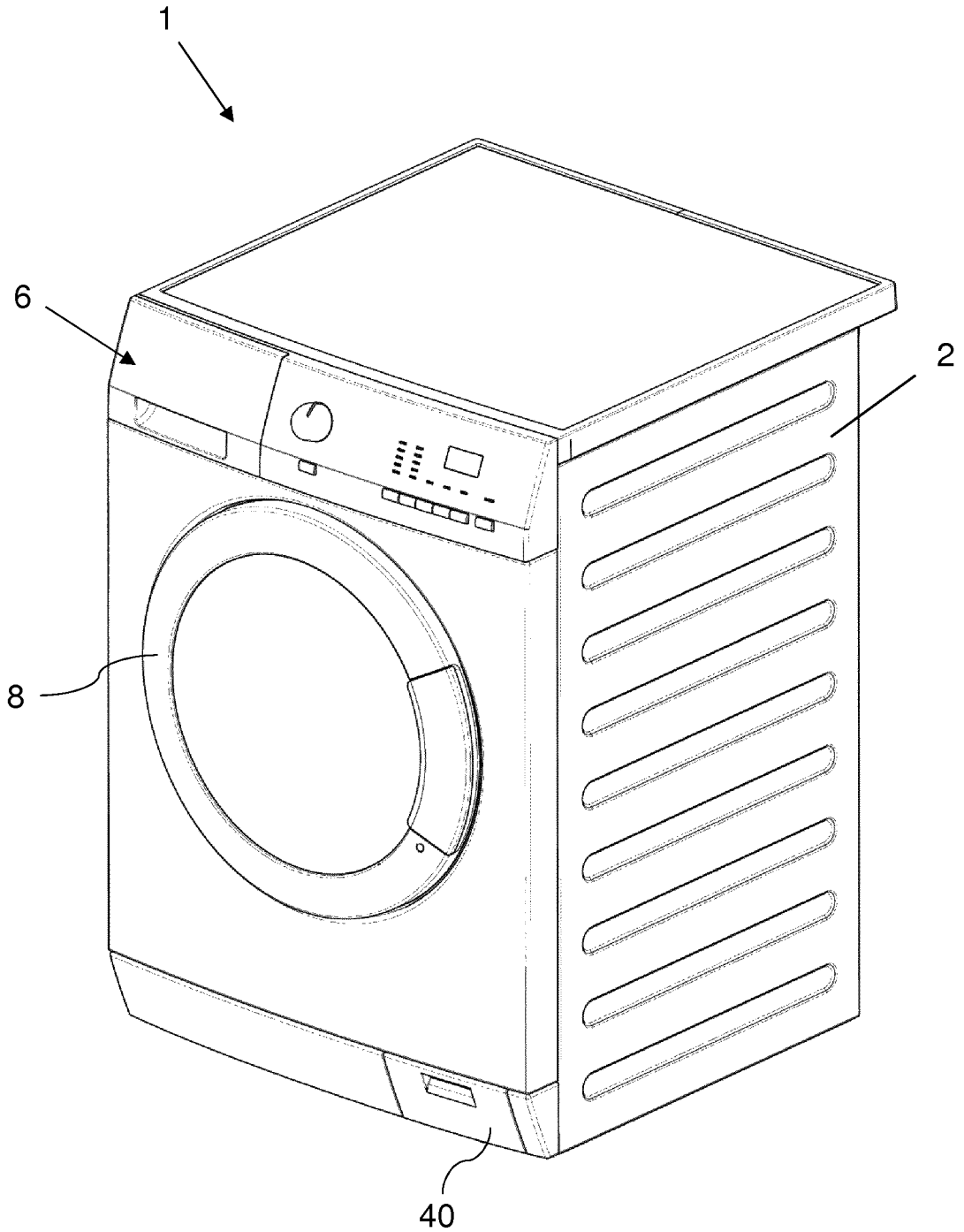
FIG. 1 shows a perspective view of a laundry washing machine according to a preferred embodiment of the invention.
Figure 2:
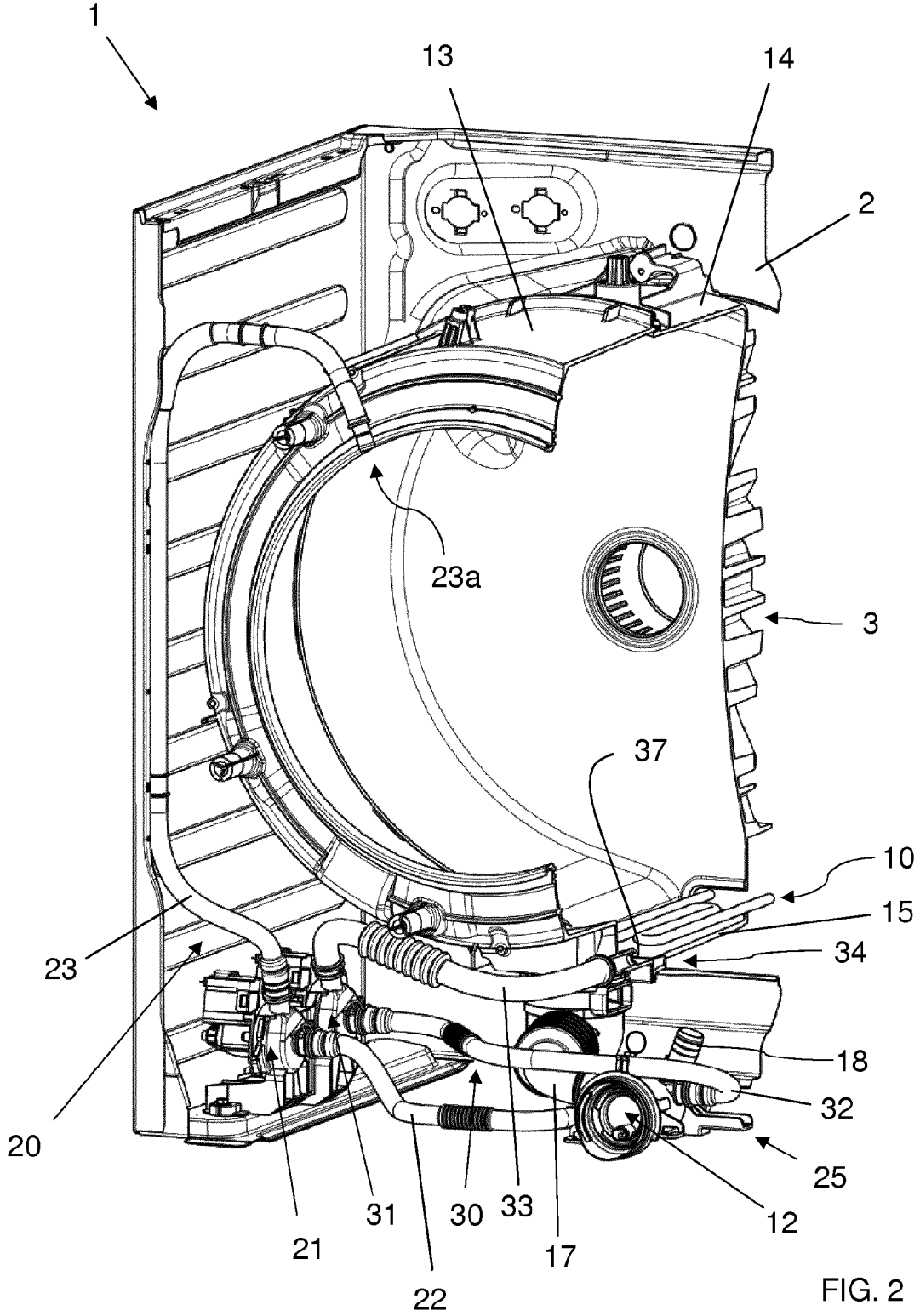
FIG. 2 shows a partial view of the laundry washing machine of FIG. 1 with the external casing partially removed.
Figure 3:
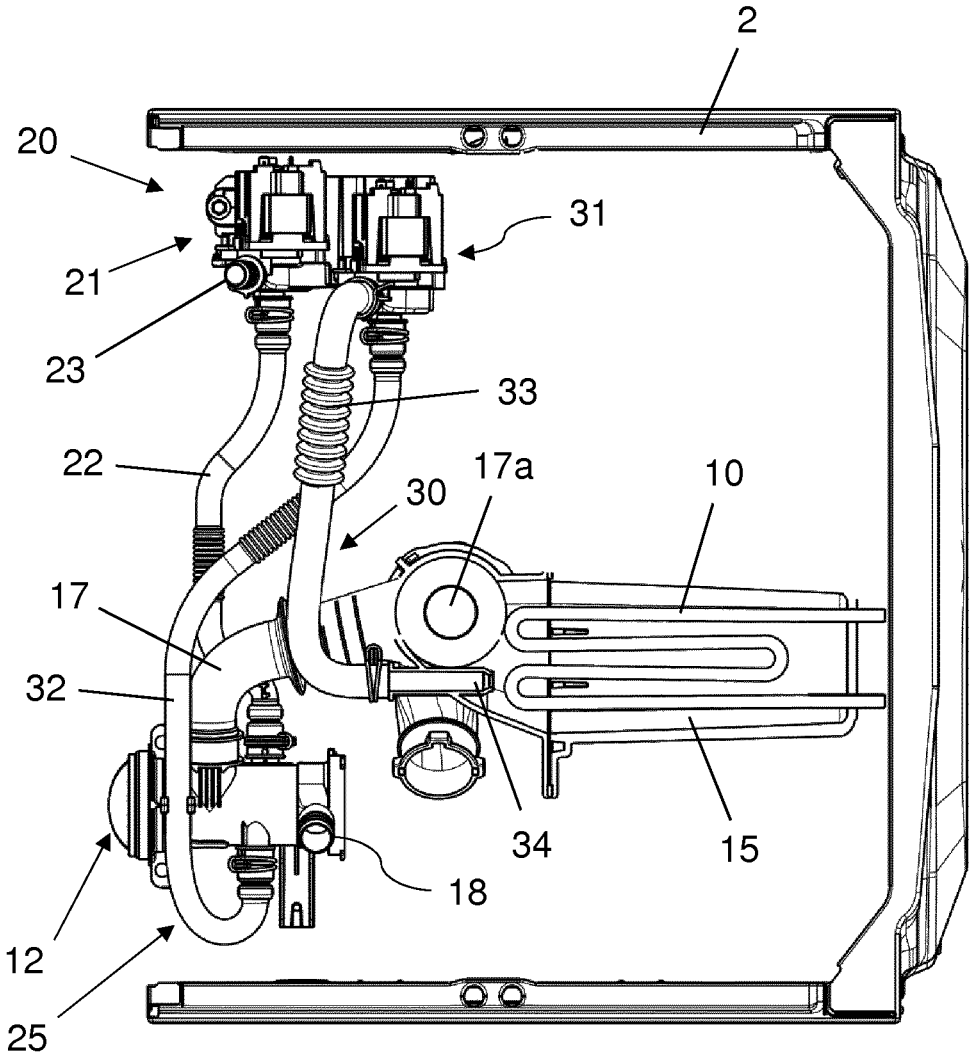
FIG. 3 is a sectional plan view of the laundry washing machine of FIG. 1 with some components isolated from the rest.

FIG. 1 shows a laundry washing machine 1 according to a preferred embodiment of the invention.

Figure 4:
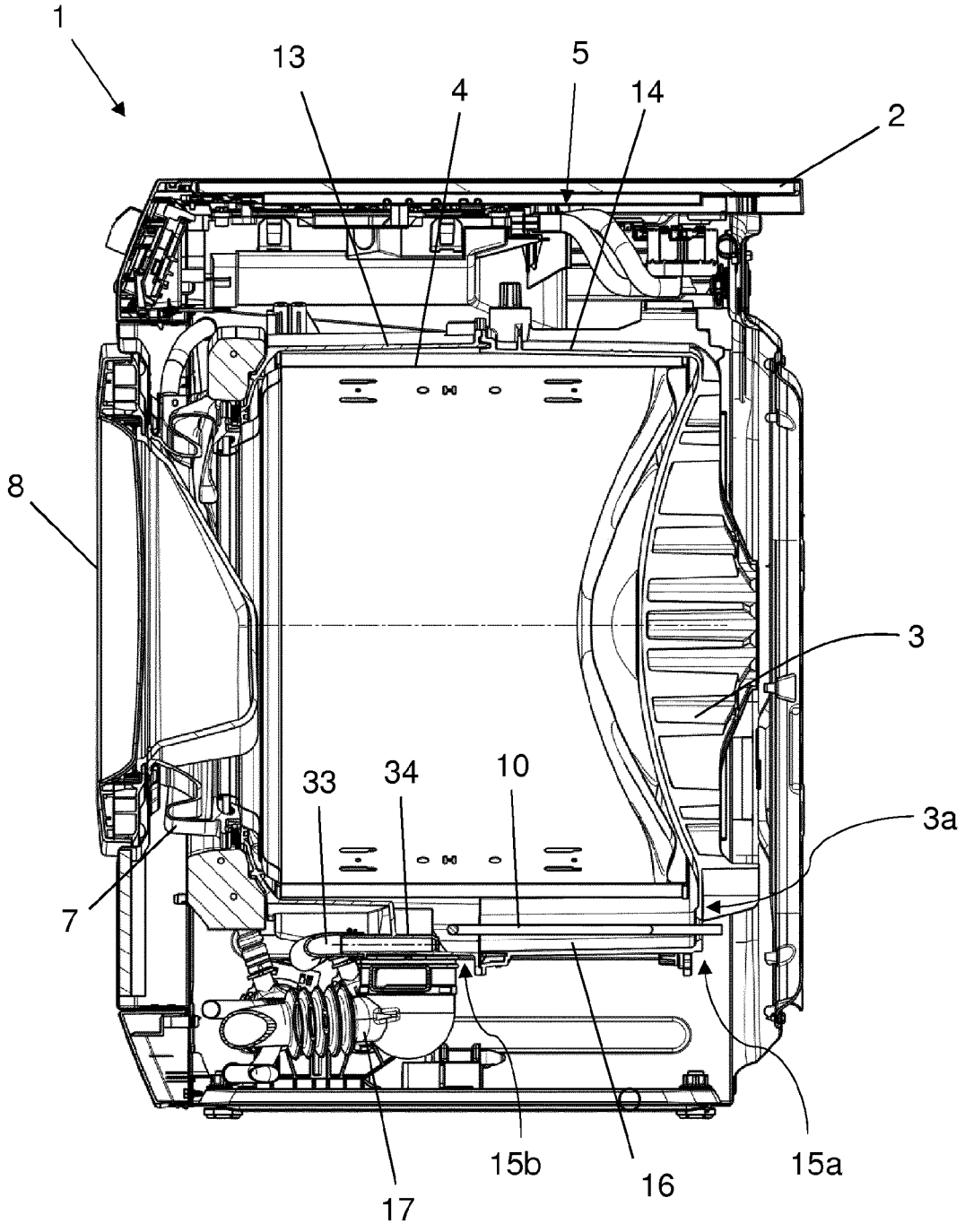
FIG. 4 is a vertical sectional view of the laundry washing machine of FIG. 1.

The laundry washing machine 1 comprises an external casing or housing 2, in which a washing tub 3 is provided that contains a rotatable perforated drum 4, visible in FIG. 4, where the laundry to be treated can be loaded.

The tub 3 and the drum 4 both preferably have a substantially cylindrical shape. The housing 2 is provided with a loading/unloading door 8 which allows access to the washing drum 4.

The tub 3 is preferably suspended in a floating manner inside the housing 2, advantageously by means of a number of coil springs and shock-absorbers, not illustrated.

The drum 4 is advantageously rotated by an electric motor which preferably transmits the rotating motion to the shaft of the drum 4, advantageously by means of a belt/pulley system. In a different embodiment of the invention, the motor can be directly associated with the shaft of the drum 4.

The tub 3 is preferably connected to the casing 2 by means of an elastic bellows 7, or gasket, as visible in FIG. 4.

Figure 8:
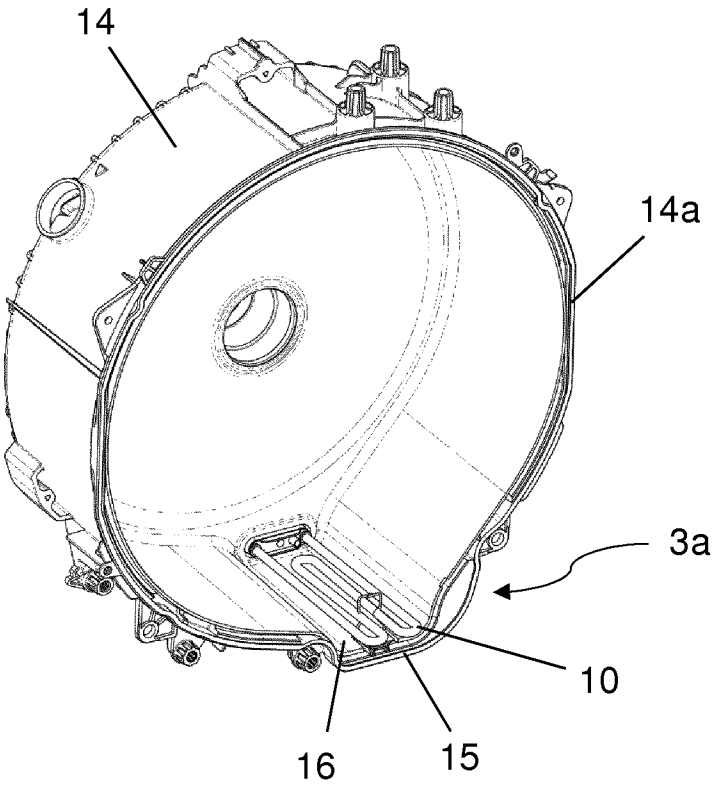
FIG. 8 shows a perspective view of a second portion of the washing tub of the laundry washing machine of FIG. 1.
Figure 7:
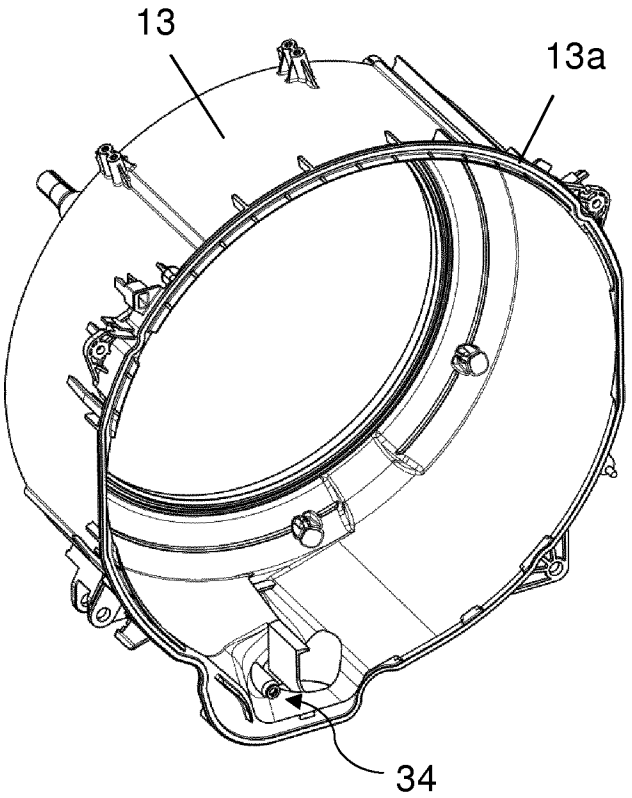
FIG. 7 shows a perspective view of a first portion of the washing tub of the laundry washing machine of FIG. 1.

The tub 3 preferably comprises two complementary hemi-shells 13 and 14, individually shown in FIGS. 7 and 8, having their peripheral edges 13*a* and 14*a* structured for being reciprocally coupled to form the tub 3.

The lower portion 3*a* of the tub 3 preferably comprises a seat 15 suitable for receiving a heater device 10. Preferably the seat 15 is made in a single piece with the tub 3, for example by injection moulding.

The heater device 10 preferably comprises an electrical resistor of serpentine type. The heater device 10 is advantageously horizontally placed in the seat 15 and it extends preferably substantially from the rear part 15*a* up to the front part 15*b* of the seat 15.

Figure 5:
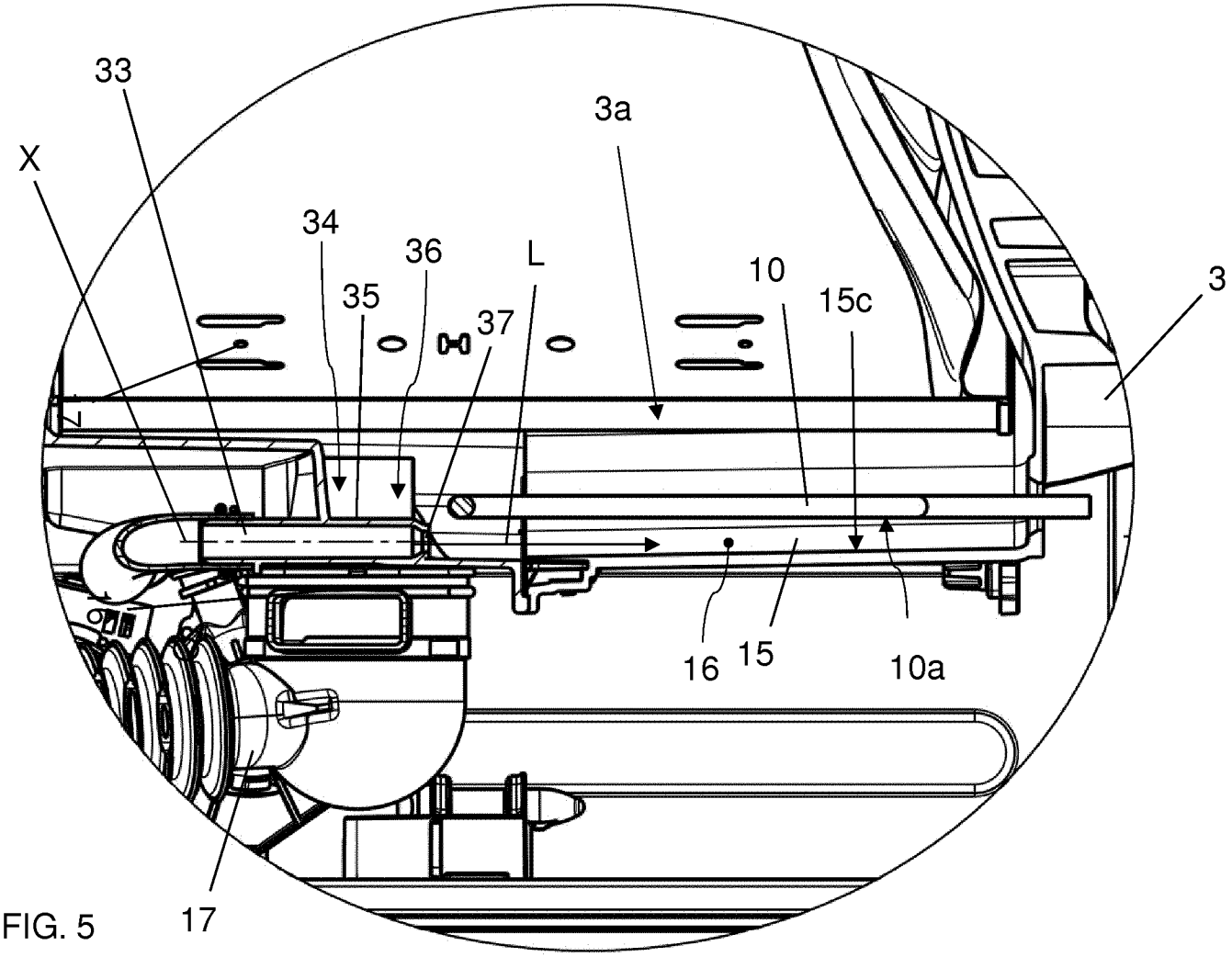
FIG. 5 shows an enlarged detail of FIG. 4.
Figure 6:
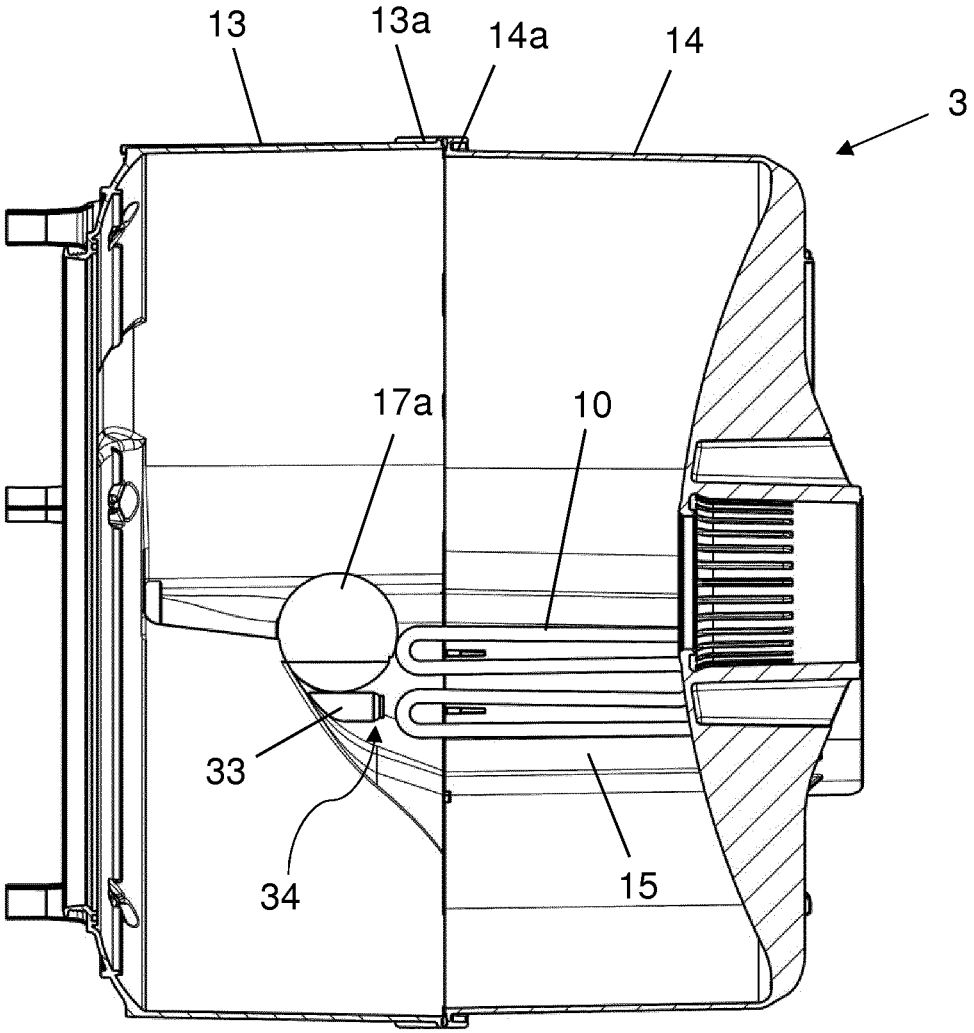
FIG. 6 is a further sectional plan view of the laundry washing machine of FIG. 1 with some components isolated from the rest.

Between the lower side 10*a* of the heater 10 (i.e. its side facing the bottom of the seat 15) and the upper surface 15*c* of the seat 15 (i.e. the surface of its bottom facing the internal of the tub) a gap 16 is defined, as illustrated in FIG. 5.

A water supply circuit 5 is arranged in the upper part of the laundry washing machine 1 and is suited to supply water into the tub 3. The water supply circuit of a laundry washing machine is well known in the art, and therefore it will not be described in detail.

The laundry washing machine 1 advantageously comprises a removable drawer 6 provided with various compartments suited to be filled with washing and/or rinsing products (i.e. detergent, softener, etc.).

In a preferred embodiment, the water is supplied into the tub 3 from the water supply circuit 5 by making it flow through the drawer 6.

The water which reaches the tub 3 can, in this case, selectively contain one of the products contained in the compartments of the drawer 6, or such water can be clean and in this case it may reach the tub 3 directly, bypassing the compartments of the drawer 6.

In an alternative embodiment of the invention, not illustrated, a further separate water supply pipe can be provided, which supplies exclusively clean water into the tub 3.

Laundry washing machine 1 advantageously comprises a water outlet circuit 25 suitable for withdrawing liquid from the lower portion 3*a* of the tub 3.

The water outlet circuit 25 preferably comprises a filtering device 12 adapted to retain all the undesirable bodies (for example buttons that have come off the laundry, coins erroneously introduced into the laundry washing machine, etc.).

This filtering device 12 can preferably be removed, and then cleaned, advantageously through a gate 40 placed advantageously on the front wall of the housing 2 of the laundry washing machine 1.

A first pipe 17 preferably connects the lower portion 3*a* of the tub 3 to the filtering device 12. A first input end 17*a* of the first pipe 17 is advantageously positioned at the lower point of the tub 3, more preferably at the lower point of the seat 15.

A main output 18 of the filtering device 12 connects the filtering device 12 to a drain pump, not illustrated. An outlet pipe, not illustrated, is connected to the drain pump and ends outside the housing 2.

Activation of the drain pump drains the liquid, i.e. dirty water or water mixed with washing and/or rinsing products, from the tub 3 to the outside.

Laundry washing machine 1 advantageously further comprises a first recirculation circuit 20 adapted to drain liquid from the lower portion 3 *a* of the tub 3 and to re-admit such a liquid into an upper region of the tub 3.

The liquid from the lower portion 3*a* of the tub 3 is conveyed towards the upper region of the tub 3 by activation of the first recirculation pump 21.

Laundry washing machine 1 advantageously further comprises a second recirculation circuit 30 adapted to drain liquid from the the lower portion 3*a* of the tub 3 and to re-admit such a liquid (recirculated liquid) into the same lower portion 3*a* of the tub 3.

Figure 9:
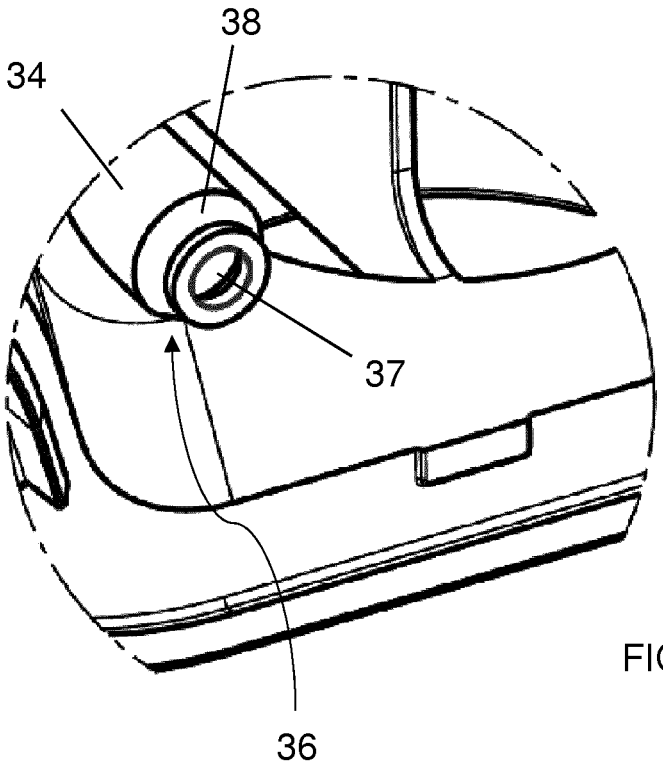
FIG. 9 shows an enlarged detail of FIG. 7.
Figure 10:
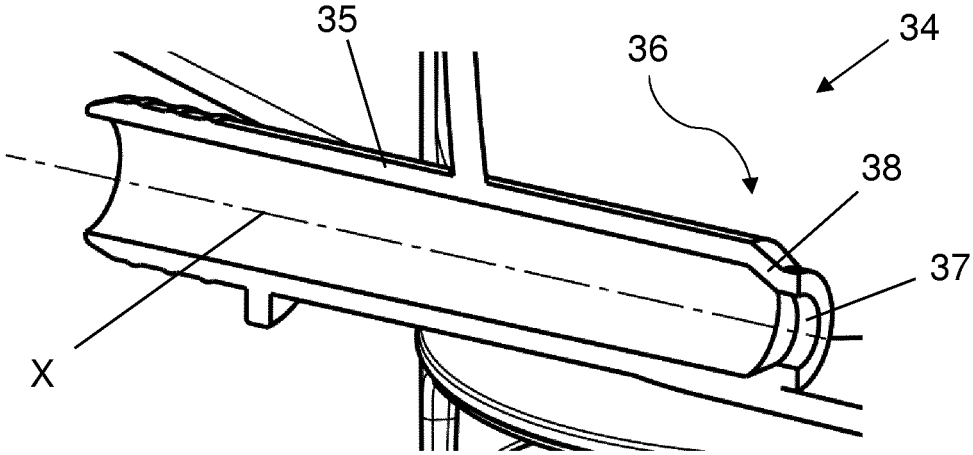
FIG. 10 is a longitudinal sectional view of the detail of FIG. 9.

The second recirculation circuit 30 preferably comprises a second recirculation pump 31, a second pipe 32 connecting the filtering device 12 (or a further filtering device, not illustrated) to the second recirculation pump 31 and a recirculation pipe 33 provided with a terminal portion 34 having a liquid output 37, better visible in FIGS. 5, 9 and 10 (in a further embodiment, not illustrated, the second recirculation circuit 30 does not comprise a filtering device).

The liquid from the lower portion 3*a* of the tub 3 is conveyed again towards the lower portion 3*a* of the tub 3, in the advantageous embodiment illustrated in enclosed figures by activation of the second recirculation pump 31, as better described below.

According to aspects of the invention, activation of the second recirculation circuit 30 is advantageously carried out when mixing and/or dissolution of the washing products is needed.

It is well known that during a washing cycle, one or more phases provides for the addition of a quantity of a washing product inside the tub 3, for example a detergent in the initial phases of the washing cycle or a rinsing product (e.g. laundry softener) in the final phases of the washing cycle.

The washing or rinsing products which are introduced into the washing tub 3, move towards the lower part 3-*a* of the tub 3 due to their density being higher than the density of water.

These products tend to accumulate in the gap 16 below the heater device 10. To achieve the dissolution of the products which accumulate in the gap 16, the terminal portion 34 of the recirculation pipe 33 is advantageously arranged in such a way to emit a jet of liquid having a main flowing direction L substantially parallel or pointed to the bottom 3-*a* of the washing tub 3, so as to remove washing/rinsing products collected therein.

Therefore the jet of liquid moves in a main flowing direction L below the heater device 10, and is advantageously adjacent to the surface 15*c* of the seat 15.

The liquid forced in the main flowing direction L from the liquid output 37 collides with the product accumulated in the gap 16 and enhances its mixing and/or dissolution in the liquid in which it is immersed.

The main flowing direction L is advantageously set along a direction which does not intersect (i.e. not collide with) the heater device 10.

This avoids formation of turbulence that would reduce the liquid speed and therefore the mixing and/or dissolution efficiency of the jet of recirculated liquid.

The terminal portion 34 of the recirculation pipe 33 preferably comprises a first tubular portion 35, more preferably a cylindrical portion. The tubular portion 35 advantageously extends along an axis X which is preferably parallel to, or coincident with, the main flowing direction L.

Such a shape for the tubular portion 35 guarantees that the jet of liquid is forced along the main flowing direction L, i.e. a direction which is substantially parallel or pointed to the bottom 3*a* of the washing tub 3.

The terminal portion 34 then comprises an end portion 36 which terminates with the liquid output 37.

Preferably the internal cross section of the end portion 36 has an area which decreases in a direction towards the liquid output 37. Therefore, the speed of the liquid inside the end portion 36, at a given pressure, increases and reaches a maximum speed at the liquid output 37, where the section has the minimum value. Therefore the jet of liquid emitted from the liquid output 37 has a relatively high speed, which is efficient for washing the bottom 3*a* of the washing tub 3, so as to remove washing/rinsing products collected therein.

The end portion 36 preferably comprises a conical-shaped or pyramidal-shaped duct 38, as visible in FIG. 10. The liquid output 37, therefore, has a substantially circular shape, as better visible in FIG. 11.

Figure 12:
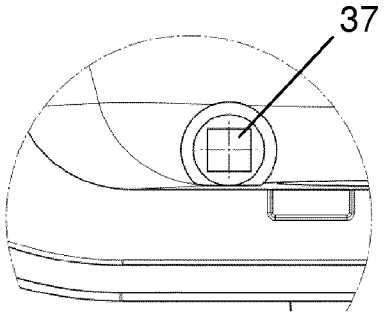
Figure 13:
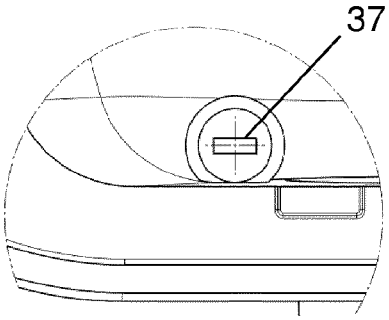

In different embodiments, nevertheless, the shape of the duct 38 and/or of the liquid output 37 may be different, as illustrated in Figures from 12 to 16. For example, the duct may have a truncated pyramid shape, more preferably a truncated rectangular based pyramid shape. In turn, the liquid output 37 may have a square shape (see FIG. 12), more preferably the liquid output 37 may have a rectangular shape (see FIG. 13). In this case, the jet of liquid emitted from the liquid output may be advantageously conveyed on the entire width of the seat 15.

Figure 14:
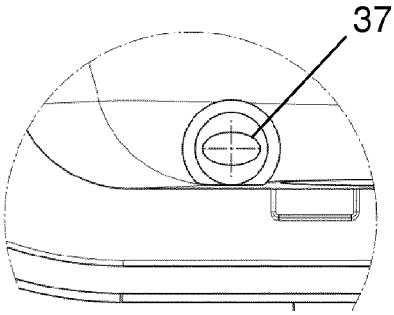

In a further embodiment, for example, the duct may have an elliptic sectional shape and, in turn, the liquid output 37 may be elliptic (see FIG. 14).

Figure 15:
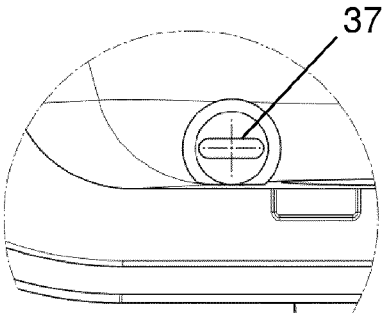

In a further embodiment, the liquid output 37 may advantageously have a rectangular shape with rounded corner (see FIG. 15).

Figure 16:
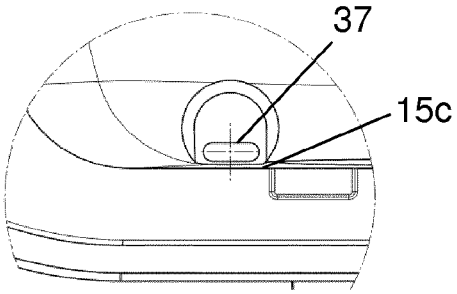

More preferably, as illustrated in FIG. 16, the liquid output 37 may be arranged closer to the upper surface 15*c* of the seat 15. Preferably the liquid output 37 may have a rectangular shape with rounded corner.

More generally, the terminal portion 34 of the recirculation pipe 33 preferably comprises an end portion 36 wherein the internal cross section has an area which decreases in a direction towards the liquid output 37.

This guarantees that the speed of the liquid at the liquid output 37 is greater than the speed of the liquid in any other points inside the terminal portion 34.

The maximum speed of the liquid at the liquid output 37 guarantees that the liquid forced in the main flowing direction L pushes the product accumulated in the gap 16 with the maximum force. In this way, the whole amount of product accumulated in the gap 16 is properly mixed and/or dissolved by the forced jet of recirculated liquid. Advantageously, the forced jet of liquid reaches also the product which accumulates in the gap 16 near the rear part 3*a* of the tub 3.

The recirculated liquid flow inside the recirculation pipe 33 is properly kept by the action of the second recirculation pump 31.

The recirculation pipe 33 and its terminal portion 34 are preferably airtight. In this way, external air is prevented to be introduced inside the recirculation pipe 33 thus maintaining the speed and pressure expected for the recirculated liquid inside the recirculation pipe 33.

Advantageously, the forced jet of recirculated liquid according to aspects of the invention avoids accumulation of products at the bottom of the tub 4 and enhances a complete and/or a fast dissolution of the products themselves in the water.

The washing performance of the washing cycle and the efficiency of the machine 1 are therefore increased.

Furthermore, all the products introduced by the user in the drawer 6 are used in the washing cycle without any loss.

Still advantageously, the second recirculation circuit 30 with the terminal portion 34 according to aspects of the invention performs a cleaning effect since no products accumulate at the bottom of the tub 3.

This guarantees good hygienic conditions inside the tub 3, in particular when the laundry washing machine in not used for a long time between two successive washing cycles.

In different embodiments, the terminal portion 34 conveying the liquid in the gap below the heater device 10 may preferably belong to a further separate water supply circuit which exclusively supplies water for dissolution of the products at the bottom of the tub. The further water supply circuit is preferably connected to an external water supply line by means of a controlled supply valve.

In this case, the further water supply circuit is advantageously activated when dissolution of the products is needed.

It has thus been shown that embodiments of the present invention allows all the set objects to be achieved. In particular, it makes it possible to obtain a laundry washing machine with improved washing efficiency with respect to the machines of the prior art. While the present invention has been described with reference to the particular embodiments shown in the figures, it should be noted that the present invention is not limited to the specific embodiments illustrated and described herein; on the contrary, further variants of the embodiments described herein fall within the scope of the present invention.

The invention claimed is:

1. A laundry washing machine comprising:

a washing tub external to a rotatable washing drum adapted to receive laundry;

a water supply circuit configured to supply water into said washing tub;

a washing/rinsing products supplier configured to supply washing/rinsing products into said washing tub;

a heater device placed at a bottom of said washing tub configured to heat a liquid coming into contact with the heater device; and a liquid output placed at said bottom of said washing tub below the heater device and configured to introduce liquid into said washing tub;

wherein said liquid output is configured to emit a jet of said liquid below the heater device, said jet having a main flowing direction substantially parallel or pointed to said bottom of said washing tub, so as to remove washing/rinsing products collected therein.

2. The laundry washing machine according to claim 1, wherein said liquid output is defined in a terminal portion of a pipe.

3. The laundry washing machine according to claim 2, wherein said terminal portion is arranged such that a speed of the liquid at said liquid output is greater than a speed of the liquid at any other points inside said terminal portion.

4. The laundry washing machine according to claim 3, further comprising a recirculation circuit configured to withdraw liquid from said washing tub, said recirculation circuit having a recirculation pipe comprising said terminal portion provided with said liquid output.

5. The laundry washing machine according to claim 2, wherein:

said terminal portion comprises an end portion, said liquid output being defined in said end portion, and said end portion having an internal cross sectional area decreasing in the direction of said liquid output.

6. The laundry washing machine according to claim 5, wherein said end portion comprises a conical-shaped duct or a pyramidal-shaped duct.

7. The laundry washing machine according to claim 5, wherein said terminal portion further comprises a tubular portion adjacent to said end portion.

8. The laundry washing machine according to claim 2, wherein said terminal portion further comprises a tubular portion.

9. The laundry washing machine according to claim 8, wherein said tubular portion extends along an axis which is parallel to said main flowing direction.

10. The laundry washing machine according to claim 2, further comprising a further water supply circuit configured to convey liquid into said washing tub, said further water supply circuit having a pipe connected to said terminal portion provided with said liquid output.

11. The laundry washing machine according to claim 1, wherein said liquid output is circular or rectangular.

12. The laundry washing machine according to claim 1, wherein said washing tub comprises a seat configured to receive said heater device, said main flowing direction of said emitted jet of liquid being substantially parallel or pointed to said bottom of said seat.

13. The laundry washing machine according to claim 1, wherein said main flowing direction does not intersect said heater device.

14. The laundry washing machine according to claim 1, further comprising a further recirculation circuit configured to withdraw liquid from said washing tub and to re-admit liquid into an upper region of said washing tub.

15. The laundry washing machine according to claim 1, wherein said machine is a laundry washing-drying machine.

16. A laundry washing machine comprising:

a washing tub external to a rotatable washing drum adapted to receive laundry;

a water supply circuit configured to supply water into said washing tub;

a washing/rinsing products supplier configured to supply washing/rinsing products into said washing tub;

a heater device placed at a bottom of said washing tub configured to heat liquid coming into contact with the heater device; and a recirculation circuit configured to withdraw liquid from said washing tub, said recirculation circuit comprising:

a recirculation pipe having a terminal portion; and a liquid output at the terminal portion of the recirculation pipe and placed at the bottom of the washing tub, the liquid output being configured to introduce liquid from the recirculation pipe into said washing tub;

wherein the liquid output is configured to emit a jet of liquid below the heater device, the jet having a main flowing direction substantially parallel or pointed to said bottom of said washing tub, so as to remove washing/rinsing products collected therein.

* * * * *